US006308364B1

(12) United States Patent
Arone

(10) Patent No.: US 6,308,364 B1
(45) Date of Patent: Oct. 30, 2001

(54) DENTURE TOOTHBRUSH

(76) Inventor: Pamela M. Arone, 7955 Magnolia Ave. #4B, Riverside, CA (US) 92504

( * ) Notice: Subject to any disclaimer, the term of this patent is extended or adjusted under 35 U.S.C. 154(b) by 0 days.

(21) Appl. No.: 09/535,565

(22) Filed: Mar. 27, 2000

(51) Int. Cl.[7] ..... A46B 9/04

(52) U.S. Cl. ..... 15/106; 15/167.1; D4/104; D4/105

(58) Field of Search ..... 15/106, 167.1; D4/104, 105

(56) References Cited

U.S. PATENT DOCUMENTS

| | | | | |
|---|---|---|---|---|
| D. 96,749 | * | 9/1935 | Hellonen | D4/104 |
| D. 99,364 | * | 4/1936 | Paisley | 15/167.1 X |
| D. 405,612 | * | 2/1999 | Swanson | D4/104 |
| D. 424,809 | * | 5/2000 | Bernard | D4/105 |
| 1,452,108 | * | 4/1923 | Carter | 15/167.1 |
| 1,893,002 | * | 1/1933 | Rothschild | 15/167.1 |
| 2,190,277 | * | 2/1940 | Viragh | 15/106 |
| 2,464,321 | * | 3/1949 | Konczal | 15/167.1 |
| 4,888,844 | * | 12/1989 | Maggs | 15/106 |
| 5,309,596 | | 5/1994 | Simms | 15/167.1 |
| 5,377,377 | | 1/1995 | Bredall et al. | 15/167.1 |
| 5,465,450 | | 11/1995 | Humphries | 15/167.1 |
| 5,488,751 | | 2/1996 | Gekhter et al. | 15/167.1 |

FOREIGN PATENT DOCUMENTS

| | | | | |
|---|---|---|---|---|
| 16815 | * | 4/1898 | (CH) | 15/106 |
| 246639 | * | 10/1947 | (CH) | 15/167.1 |
| 671866 | * | 10/1989 | (CH) | 15/167.1 |
| 249193 | * | 3/1926 | (GB) | 15/167.1 |
| 265690 | * | 2/1927 | (GB) | 15/167.1 |
| 348048 | * | 7/1937 | (IT) | 15/167.1 |

* cited by examiner

*Primary Examiner*—Mark Spisich
(74) *Attorney, Agent, or Firm*—Henderson & Sturm LLP

(57) ABSTRACT

A denture toothbrush including a head with a rounded section extending from its distal end back toward the neck position and a flat section on one side of the head extending from a point spaced back from the distal end to the neck portion. A first set of bristles extend radially out from the rounded section and a second set of bristles extend out perpendicular to the flat section. The first set of rounded bristles resemble a bottle brush and make contact with the curved gum areas on the inside of the dentures. The second set of straight bristles are adapted to clean the teeth and area on the outside of the denture.

1 Claim, 1 Drawing Sheet

DENTURE TOOTHBRUSH

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of toothbrushes, and more particularly to a denture toothbrush.

2. Description of Related Art

As can be seen by reference to the following U.S. Pat. Nos. 5,309,596; 5,377,377; 5,465,450 and 5,488,751 the prior art is replete with myriad and diverse toothbrushes.

While all of the aforementioned prior art constructions are more than adequate for the basic purpose and function for which they have been specifically designed, they are uniformly deficient with respect to their failure to provide a simple, efficient, and practical denture toothbrush suitable for cleaning the inside surface of dentures.

As a consequence of the foregoing situation, there has existed a longstanding need for a new and improved denture toothbrush and the provision of such a construction is a stated objective of the present invention.

BRIEF SUMMARY OF THE INVENTION

Briefly stated, the present invention provides a denture toothbrush including a head with a rounded section extending from its distal end back toward the neck position and a flat section on one side of the head extending from a point spaced back from the distal end to the neck portion. A first set of bristles extend radially out from the rounded section and a second set of bristles extend out perpendicular to the flat section. The first set of rounded bristles resemble a bottle brush and make contact with the curved gum areas on the inside of the dentures. The second set of straight bristles are adapted to clean the teeth and area on the outside of the denture.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
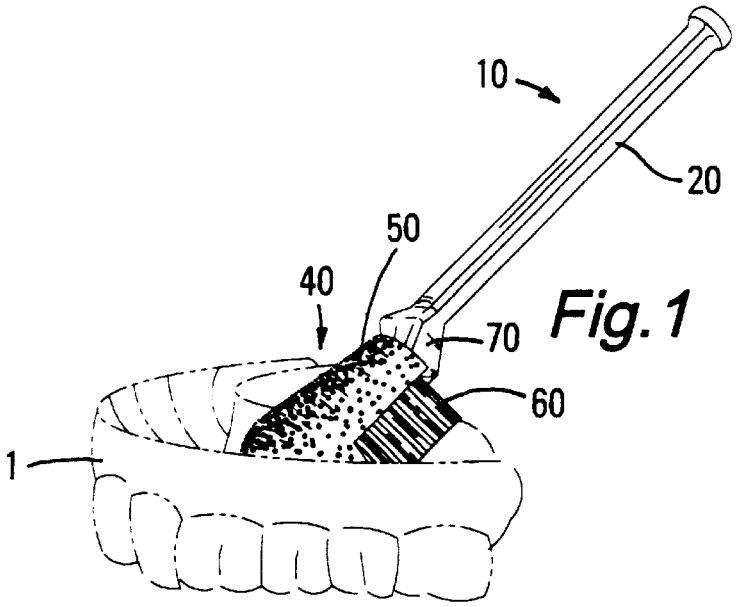
FIG. 1 is a perspective view of the denture toothbrush of the present invention in use cleaning the curved gum areas on the inside of a denture.
Figure 2:
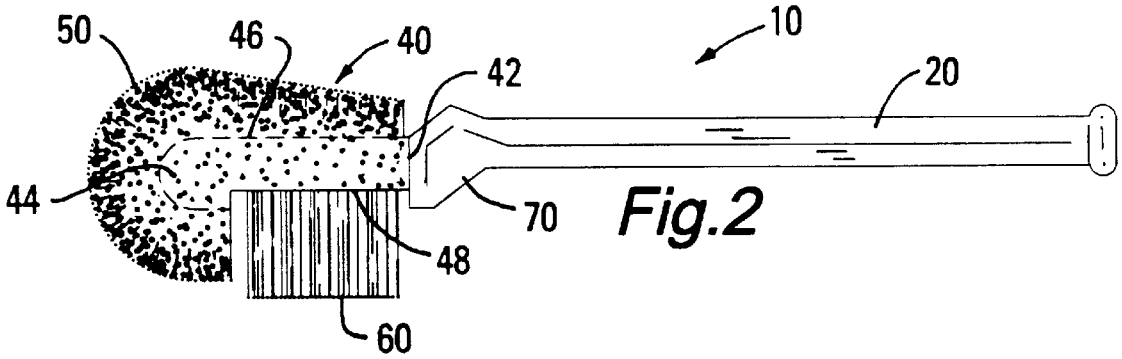
FIG. 2 is a side elevational view of the denture toothbrush.
Figure 3:
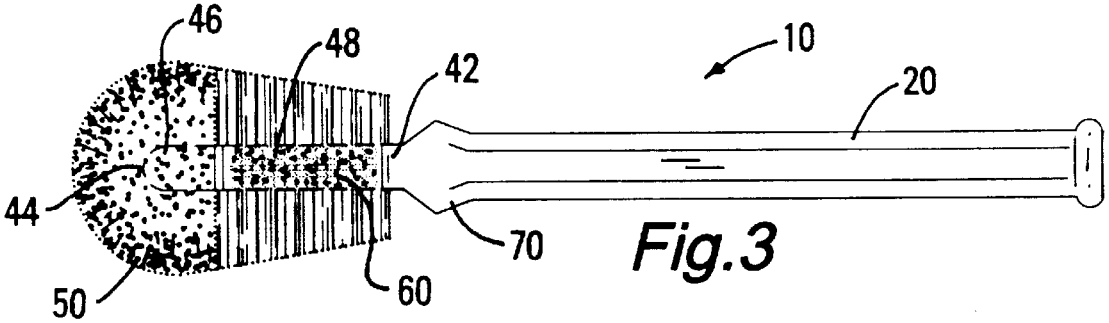
FIG. 3 is a bottom plan view thereof.
Figure 4:
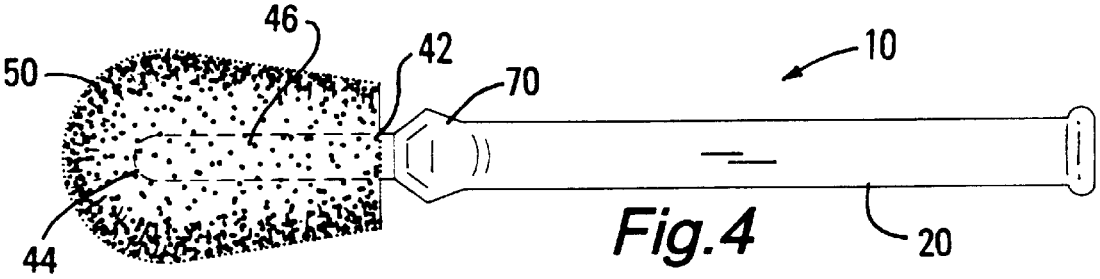
FIG. 4 is a top plan view thereof.

As can be seen by reference to the drawings, and in particularly to FIG. 1, the denture toothbrush that forms the basis of the present invention is designated generally by the reference number 10. The toothbrush 10 is adapted for use in cleaning both the curved gum areas on the inside of a denture 1 and the teeth and other areas on the outside of the denture 1. The toothbrush 10 includes an elongated handle 20, a head 40, and a neck portion 70 that interconnects the handle 20 and the head 40.

The head 40 has a proximal end 42 connected to the neck portion 70 and a distal end 44. A generally rounded section 46 extends back from the distal end 44 toward the proximal end 42. A flat section 48 is formed on one side of the head 40 and extends from a point spaced back from the distal end 44 to the proximal end 42.

A first set of bristles 50 extend radially out from the rounded section 46 and resemble a rounded bottle brush covering the distal end 44 and extending back toward the proximal end 42. The first set of bristles 50 are longer at the distal end 44 and shorter at the proximal end 42 giving a rounded tapered appearance. A second set of bristles 60 extend straight out perpendicular to the flat section 48.

The rounded bristles 50 are adapted to clean the curved gum areas on the inside of dentures 1 and the straight bristles 60 are adapted to clean the teeth and other areas on the outside of the denture 1.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A denture toothbrush, comprising:

an elongated handle, a head, and a neck portion interconnecting the handle and the head;

the head including a proximal end connected to the neck portion and a distal end, the head including a rounded section extending from the distal end back to the proximal end and a flat section formed on one side of the head extending from a point spaced back from the distal end to the proximal end;

a first set of bristles extending out from all portions of the rounded section of the head, wherein the first set of bristles are tapered being longer at the distal end than at the proximal end; and a second set of bristles extending out perpendicular to the flat section.

* * * * *